United States Patent [19]

Brantley

[11] 4,183,720

[45] Jan. 15, 1980

[54] COMPOSITE FAN BLADE PLATFORM DOUBLE WEDGE CENTRIFUGAL SEAL

[75] Inventor: James W. Brantley, Fairfield, Ohio

[73] Assignee: The United States of America as represented by the Secretary of the Air Force, Washington, D.C.

[21] Appl. No.: 866,726

[22] Filed: Jan. 3, 1978

[51] Int. Cl.[2] ..... F01D 5/22

[52] U.S. Cl. ..... 416/193 A; 416/196 R; 416/500

[58] Field of Search ..... 416/193 A, 190, 191, 416/196 R, 500, 221

[56] References Cited

U.S. PATENT DOCUMENTS

| | | | |
|---|---|---|---|
| 1,554,614 | 9/1925 | Allen | 416/190 |
| 2,356,605 | 8/1944 | Meininghaus | 416/193 A X |
| 3,266,771 | 8/1966 | Morley | 416/193 A X |
| 3,709,631 | 1/1973 | Karstensen et al. | 416/193 A X |
| 3,734,639 | 5/1973 | Short | 416/193 A X |
| 3,752,598 | 8/1973 | Bowers et al. | 416/193 A X |
| 3,936,222 | 2/1976 | Asplund et al. | 416/193 A X |

*Primary Examiner*—Everette A. Powell, Jr.

*Attorney, Agent, or Firm*—Joseph E. Rusz; Arsen Tashjian

[57] ABSTRACT

A sealing arrangement for preventing compressor fan air loss through the relatively wide gaps between adjacent blade platforms required in order to allow for rotation of the blades around their minor root axes in response to bird impact and the like. A thin flexible ribbon-like seal is bonded to one of the two adjacent blade platforms in the fan structure. At the gap, the seal includes a thickened wedge shaped portion with at least one invagination on the inner side facing the rotor axis. At the operating speed of the compressor fan, centrifugal force causes the thickened portion to be forced into the gap between adjacent platforms producing the required seal.

3 Claims, 8 Drawing Figures

FIG. 3
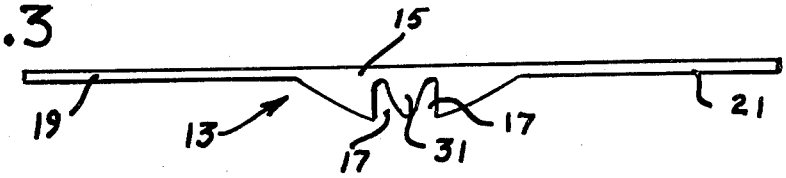
FIG. 4
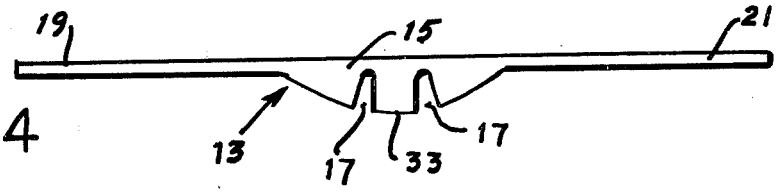
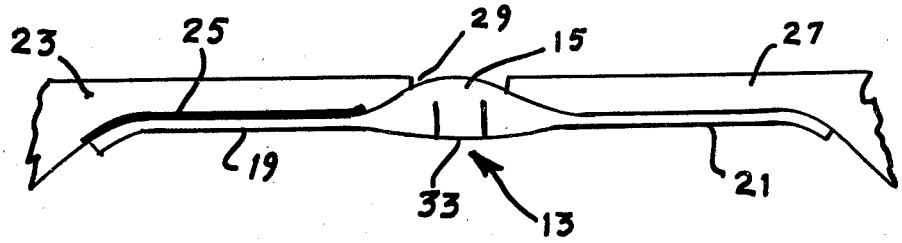
FIG. 5
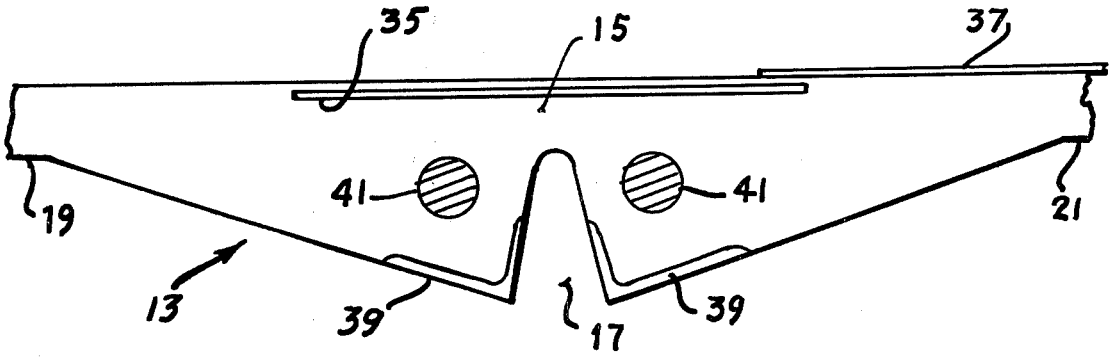
FIG. 6

COMPOSITE FAN BLADE PLATFORM DOUBLE WEDGE CENTRIFUGAL SEAL

STATEMENT OF GOVERNMENT INTEREST

The invention described herein may be manufactured and used by or for the Government for governmental purposes without the payment of any royalty thereon.

BACKGROUND OF THE INVENTION

This invention relates to a seal member for preventing fan air loss through the fan blade root structure in a turbojet compressor section and, more particularly, the invention is concerned with providing a blade seal arrangement including a thin flexible ribbon-like seal having a thickened wedge-shaped portion along its longitudinal center in contact with the gap between two adjacent blade platforms and impelled into the gap during operation of the compressor fan. The seal is fixedly attached to one of the adjacent blade platforms and the thickened portion of the seal includes invaginations which close as the wedge portion fills the gap between the blade platforms.

Heretofore it has been the common practice in certain types of turbojet engines to provide thin flexible seals between adjacent platforms of the composite fan blades. One side of the seal is fixedly attached by cementing or the like to one of the blade platforms while the other side hangs loose over the gap so that when the fan starts to rotate the seal is centrifuged across the gap producing an effective seal. This arrangement is satisfactory where the gap is relatively narrow as in the F101 engine. However, where the gap is wide, the loose side of the thin seal is centrifuged through the gap. When this happens, the seal is ineffective and protrudes into the air stream. If this type of seal of constant thickness were made thick enough to function properly, the added stiffness and unwanted weight would outweigh the advantages obtained.

In the F103, the composite fan blade is required to swing about its root minor axis at least 15° counterclockwise (looking forward) during bird impact and a 5° clockwise swing back following impact. Since the blade platform is attached to the blade, adjacent platforms must clear each other as one blade swings relative to an adjacent blade. This requires a significant gap between adjacent platforms which make up the fan air stream inner flowpath between blades. To minimize fan air loss, the gap must be filled during normal fan operations, but must still allow relative movement between platforms when bird strikes occur. The seal need not remain functional after a severe bird strike. The thin constant thickness F101 seal previously described will not operate in a satisfactory manner with the wide gap required in the F103 engine.

SUMMARY OF THE INVENTION

The present invention is concerned with providing a sealing arrangement for preventing compressor fan air loss through relatively wide gaps between adjacent blade platforms. In certain turbojet engines there is a required swing capability of 15° counterclockwise and 5° clockwise "swing back" around the root minor axis of the composite fan blade following bird impact. This requirement calls or a significant gap between adjacent blade platforms in order to allow for relative swinging movement between the adjacent blades. The present invention provides a thin flexible ribbon-like seal bonded to one of the two adjacent blade platforms. A thickened double wedge shaped portion is included along the centerline of seal under the gap. As the fan reaches operating speed, the wedge portion of the seal is centrifuged into the gap and an invagination on the inner side of the wedge portion of the seal closes. This completely fills the volume of the gap and the wedge portion prevents the seal from being centrifuged through the gap. Also, the folded double wedge becomes flush with the flowpath surface thereby minimizing the flowpath discontinuity.

Accordingly, it is an object of the invention to provide a composite fan blade platform double wedge centrifugal seal suitable for preventing air leakage through the gap between adjacent fan blade platforms.

Another object of the invention is to provide a fan blade platform seal having flexible legs on both sides of a double wedge portion allowing the seal to be symmetrical thereby facilitating assembly by eliminating the possibility of reversed installation.

Still another object of the invention is to provide a blade platform double wedge seal wherein the seal legs are thinner than a constant thickness seal which allows more flexibility so that the seal can be readily forced by light hand pressure to conform to the bonding surface contour of one platform and to the sealing surface contour of the adjacent platform. The thinness of the flexible seal legs also facilitates the assembly of the last fan blade of a full stage by being capable of being depressed or folded out of the way during blade assembly.

A further object of the invention is to provide a fan blade platform seal having a double wedge design to provide a smoother flowpath for the fan air stream when the seal is centrifuged into the gap with the wedge portion out of the air stream. The double wedge seal being centrifuged between adjacent platform edges provides mechanical damping to assist in the control of blade vibrations.

A still further objedt of the present invention is to provide a fan blade platform double wedge seal wherein the double wedge is readily disengaged during bird impact to allow relative motion between platforms because the sealing surface upon which the double wedge is seated is parallel to the locus of the adjacent platform edge during the platform relative motion. The double wedge seal will reseat after small to moderate size bird impact. Under such impact, relative platform motion will be small (less than 2°) after which the seal will reseat.

Another still further object of the invention is to provide a composite blade platform double wedge centrifugal seal which is relatively simple to fabricate in a continuous ribbon molding that is substantially flat. The seal is readily replaceable by complete old seal removal and rebonding of a new seal. A dislodged seal ingested into the engine would not result in mechanical damage.

These and other objects, features and advantages will become more apparent after considering the following detailed description taken in conjunction with the annexed drawings and appended claims.

BRIEF DESCRIPTION OF THE DRAWINGS

FIG. 3 is a view in cross-section of another embodiment of a double wedge centrifugal seal;

FIG. 4 is a view in cross-section of still another embodiment of a double wedge centrifugal seal;

FIG. 5 is a view in cross-section of the seal of FIG. 4 installed in position between two adjacent blade platforms with the engine in operating condition; and FIG. 6 is an enlarged view in cross-section of a double wedge centrifugal seal showing various additional features for improving the operation and wear characteristics.

DESCRIPTION OF A PREFERRED EMBODIMENT

Figure 1:
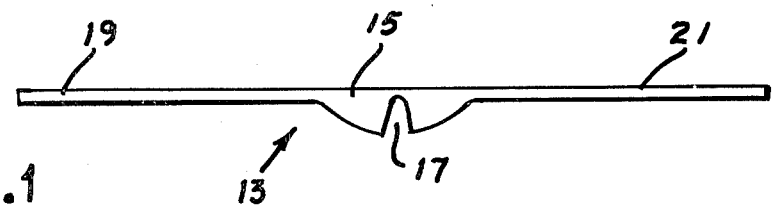
FIG. 1 is a view in cross-section of a preferred embodiment of a double wedge centrifugal seal according to the invention as molded in ribbon form.

Referring now to FIG. 1, there is shown in cross-section a preferred embodiment of the seal 13 according to the invention, including the double wedge portion 15 having the invagination 17 therein. The seal includes a left leg portion 19 and a right leg portion 21. The left leg portion 19 is bonded to the inner surface of the left blade platform 23 at the point 25 by means of any suitable adhesive material. The right leg portion 21 hangs free near the inner surface of the right blade platform 27. Between the left and right blade platforms 23 and 27, there is a gap 29 which is relatively wide in order to allow for a large swing capability in response to bird impact. The seal 13 is fabricated of a flexible material with low modulus such as silicone potting compound.

Figure 2A:
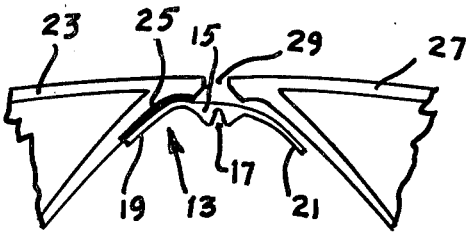
FIG. 2*a* is a view in cross-section of the seal of FIG. 1 installed in position between two adjacent blade platforms with the engine in static condition.

In FIG. 2*a*, the seal 13 is shown with the engine in the static condition. The left leg 19 of the seal 13 is bonded to the inner surface of the left blade platform 23 at the point 25. This leg 19 is sufficiently flexible to be readily formed to the bonding surface contour at 25. The right leg portion 21 hangs free near the inner surface of the right blade platform 27. The wedge portion 15 of the seal 13 is located immediately under the gap 29 and the invagination 17 in the wedge 15 is wide open.

Figure 2B:
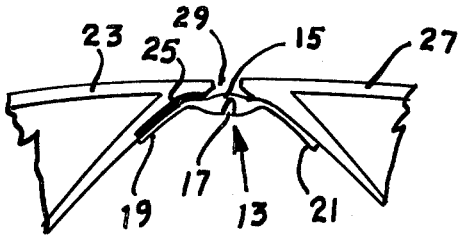
FIG. 2*b* is a view in cross-section of the seal of FIG. 1 installed in position with the engine in start up condition.
Figure 2C:
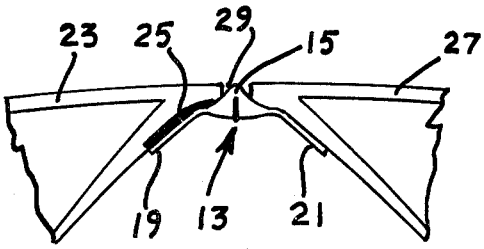
FIG. 2*c* is a view in cross-section of the seal of FIG. 1 installed in position with the engine in operating condition.

As the fan starts to rotate, the seal 13, as shown in FIG. 2*b*, starts to move outward and the right leg portion 21 is pressed against the inner surface of the right blade platform 27. The wedge portion 15 of the seal 13 begins to move into the gap 29 and the invagination 17 begins to close. When the fan reaches operating condition, as shown in FIG. 2*c*, wedge 15 which is actually of double wedge configuration, folds into a single wedge as it fills the gap 29 and the invagination 17 closes completely. In this condition, the wedge 15 is too large to be centrifuged through the gap and an effective seal is formed.

In FIG. 3, there is shown in cross-section another embodiment of the invention wherein the seal 13 includes a wedge 15 having a center block 31 with two invaginations 17, one on each side thereof. The center block 31 in this embodiment (FIG. 3) is substantially triangular in configuration. In the embodiment shown in FIG. 4, the center block 33 is substantially square in configuration. In FIG. 5 the embodiment of FIG. 4 is shown with the fan rotating at operating velocity. The wedge 15 completely fills the gap 29 and the invaginations 17 are fully closed. Thus, the gap 29 between the adjacent blade platforms 23 and 27 is effectively sealed reducing fan air loss to a minimum while at the same time, the blade platforms are provided with sufficient clearance to permit relative movement therebetween in response to bird strikes and the like.

In FIG. 6, there is shown the preferred embodiment of the blade platform double wedge seal with additional features which may be added to improve the operation and wear characteristics of the seal 13. A flexible material 5 with high modulus such as nylon fabric or graphite fiber may be embedded in or applied to the top surface of the wedge portion 15 of the seal 13 adding to the tensile strength thereof. This feature is particularly important where the gap 29 is extra wide and the low modulus of the base material is insufficient to resist being forced through the gap 29 by centrifugal action. A wear resistant surface can be added to the top surface of the seal 13 in the area of the right leg portion 21 in order to prevent damage to the seal 13 where it would normally contact the adjacent blade platform during operation. Other wear resistant surfaces 39 of rigid material for compressive strength such as advanced composites or metal cladding may be applied to the lower corners of the invagination 17 to resist compressive deformation. For wide gaps where the stiffness of the low modulus base material is insufficient to resist being forced through the gap 29, the surface 39 are necessary. The weights 41 can be molded in the wedge portion 15 of the seal 13 in order to increase the sealing capability against air stream static pressure as required.

Thus it can be seen that the hereinbefore described double wedge centrifugal seal 13 including the volume of the wedge 15 are sized so as to completely fill the volume of the gap 29 plus a small additional volume thereby improving the resistance of the folded double seal to be centrifuged through the gap 29. Also, the folded double wedge seal 13 becomes flush with the flowpath surface thereby minimizing the flowpath discontinuity. The loose flexible unbonded leg 21 completes the seal as it is centrifuged onto the adjacent platform 27 during operating conditions (FIG. 2*c*).

Although the invention has been illustrated in the accompanying drawings and described in the foregoing specification in terms of preferred embodiments thereof, the invention is not limited to these embodiments or to the preferred configurations shown. It will be apparent to those skilled in the art that my invention could have extensive use in other operations where it is necessary to seal the gap between adjacent blade platforms in various turbine compressors and the like.

Having thus set forth the nature of my invention, what I claim and desire to secure by Letters Patent of the United States is:

1. In a turbojet engine having a rotatable turbine wheel, turbine blades with blade platforms secured about the periphery of the wheel, said blade platforms being provided with clearance gaps between the adjacent edges thereof to allow for individual relative rotational movement of said turbine blades around their minor root axes; sealing means for preventing turbine air from escaping through the gaps between the blade platforms, said sealing means comprising an elongated flexible ribbon-like member having a left leg portion extending outwardly to the left and a right leg portion extending outwardly to the right, a central wedge portion between said left and right leg portions, at least one invagination on the inner side of said wedge portion facing the turbine wheel axis, said central wedge portion being positioned directly under the gap between two adjacent blade platforms, the left leg portion of said sealing means being fixedly bonded to the underside of one blade platform, the sealing means being urged radially outward at the engine operating speed in response to centrifugal force causing the wedge portion of the sealing means to enter and fill the gap between the blade platforms causing the invagination to close and the right leg portion of the sealing means to press against the underside of the next adjacent blade platform thereby providing the required seal.

2. The sealing means defined in claim 1 wherein said central wedge portion includes two invaginations with a central body of substantially triangular cross-section therebetween.

3. The sealing means defined in claim 1 wherein said central wedge portion includes two invaginations with a central body of substantially square cross-section therebetween.

* * * * *